US011444413B2

(12) United States Patent
Poemmerl

(10) Patent No.: US 11,444,413 B2
(45) Date of Patent: Sep. 13, 2022

(54) PLUG AND SOCKET DEVICE

(71) Applicant: Bayerische Motoren Werke Aktiengesellschaft, Munich (DE)

(72) Inventor: Josef Poemmerl, Furth (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 61 days.

(21) Appl. No.: 16/976,124

(22) PCT Filed: Aug. 27, 2019

(86) PCT No.: PCT/EP2019/072850
§ 371 (c)(1),
(2) Date: Aug. 27, 2020

(87) PCT Pub. No.: WO2020/052969
PCT Pub. Date: Mar. 19, 2020

(65) Prior Publication Data

US 2020/0412058 A1 Dec. 31, 2020

(30) Foreign Application Priority Data

Sep. 13, 2018 (DE) ..... 10 2018 215 574.7

(51) Int. Cl.
*H01R 13/641* (2006.01)
*H01R 13/66* (2006.01)
*H01R 13/717* (2006.01)

(52) U.S. Cl.
CPC ..... *H01R 13/641* (2013.01); *H01R 13/6691* (2013.01); *H01R 13/7175* (2013.01)

(58) Field of Classification Search
CPC ..... H01R 13/641; H01R 13/6691; H01R 13/7175; H01R 13/70
See application file for complete search history.

(56) References Cited

U.S. PATENT DOCUMENTS

| | | | | |
|---|---|---|---|---|
| 5,112,246 | A | 5/1992 | Kawase et al. | |
| 9,401,572 | B1 * | 7/2016 | Jones | H01R 13/641 |
| 10,389,065 | B2 * | 8/2019 | Goodson, II | H01R 43/26 |
| 10,483,690 | B1 * | 11/2019 | Stanfield | H01R 13/6275 |
| 10,690,862 | B2 * | 6/2020 | Takeuchi | H01R 13/641 |

(Continued)

FOREIGN PATENT DOCUMENTS

| | | | |
|---|---|---|---|
| DE | 200 02 594 U1 | 6/2000 | |
| DE | 102 61 016 A1 | 7/2004 | |
| DE | 202016106664 U1 * | 12/2016 | H01R 13/641 |

(Continued)

OTHER PUBLICATIONS

International Search Report (PCT/ISA/210) issued in PCT Application No. PCT/EP2019/072850 dated Nov. 25, 2019 (five pages).

(Continued)

*Primary Examiner* — Tho D Ta
(74) *Attorney, Agent, or Firm* — Crowell & Moring LLP

(57) ABSTRACT

A plug and socket device includes a plug, which can be inserted in a socket. The plug or the socket has a detection unit designed to detect the correct positioning of the plug in the socket. The detection unit has a switching element designed to be mechanically activated when the plug is correctly positioned.

9 Claims, 1 Drawing Sheet

(56) References Cited

U.S. PATENT DOCUMENTS

2004/0166725 A1 8/2004 Simmel

FOREIGN PATENT DOCUMENTS

| | | | | | |
|---|---|---|---|---|---|
| DE | 102016208594 | A1 * | 11/2017 | ..... | H01R 13/7032 |
| WO | WO 2007/016956 | A1 | 2/2007 | | |
| WO | WO 2008/142490 | A1 | 11/2008 | | |
| WO | WO 2015/143183 | A1 | 9/2015 | | |

OTHER PUBLICATIONS

German-language Written Opinion (PCT/ISA/237) issued in PCT Application No. PCT/EP2019/072850 dated Nov. 25, 2019 (six pages).
German-language Office Action issued in German Application No. 10 2018 215 574.7 dated May 7, 2019 (five pages).
Cover page of EP 2 153 496 A1, published on Feb. 17, 2010 (one page).

* cited by examiner

PLUG AND SOCKET DEVICE

BACKGROUND AND SUMMARY OF THE INVENTION

The present invention relates to a plug and socket device having a plug and a socket, wherein the plug is able to be inserted into the socket.

In critical applications, such as for example high-voltage systems, it is important to detect whether a plug connection, that is to say a connection between a plug and a socket for transmitting electric power, is correctly connected. Such plug connections are usually joined together manually. Depending on the design of the plug and the socket or receptacle, that is to say the number of poles, the contact and housing design and other features, the required plugging force may change to a great extent. If a plug connection is not joined together until the components abut, although there is still usually electrical contact, the tightness and resistance to vibrations of such a plug connection decreases over time. This may ultimately lead to failure of the plug connection and thus to failure of the system in question.

In order to prevent detachment of such a plug connection, what are known as housing locks may be used, which may also be referred to as connector position assurance (CPA). These may be actuated mechanically only when the plug is 100% in its final position. Such a housing lock firstly confirms a correctly connected plug connection and at the same time prevents unwanted detachment of this plug connection.

However, such a housing lock is normally installed by a single installer. This is the only person who has acoustic, visual and haptic feedback about the correct connection of the plug connection and is thus able to check same. There is however no automatic electronic monitoring of the plug connection. It may thus be the case that the plug is not inserted correctly during installation and the housing lock is then not closed by the installer. If this defect is overlooked in a final inspection, this may lead to failure or to detachment of the plug connection.

What are known as high-voltage interlock contacts (HVIL) may additionally be used in high-voltage applications. Such a contact monitors the correct connection of plug connections in the high-voltage circuit via a series connection that runs from plug connection to plug connection. If the circuit of this series connection is interrupted by removing one of the plug connections, then this is detected. However, such contacts are expensive and the correct positioning in a plug connection is not able to be checked automatically.

The object of the present invention is therefore to provide a plug and socket device by way of which it is possible to automatically detect correct positioning or insertion of a plug into a socket.

This object is achieved by a plug and socket device having a plug and a socket according to the independent claims, wherein the plug is able to be inserted into the socket.

In order to detect whether the plug is positioned correctly in the socket, that is to say whether the plug is inserted completely into the socket, there is provision for a detection unit that may be formed either on the plug or on the socket. The detection unit has a switching element that is designed to be mechanically activated in the event of correct positioning. This means that the switching element is activated mechanically by the plug or the socket when the plug is inserted completely into the socket. If the switching element is activated, this is detected and the detection unit may then display the fact that the plug is positioned correctly in the socket.

The display may be visual or acoustic. By way of example, the detection unit may have an LED that lights up when correct positioning is detected.

Since no additional HVIL contacts are necessary in the case of the plug and socket device proposed here, it is possible to save on costs in comparison with such known systems.

Since the detection unit is provided on only one of the elements, that is to say only on the plug or only on the socket, the detection unit is able to be attached particularly easily since it is not necessary to attach two elements to the plug and the socket that each need to be individually positioned correctly in order to be able to operate interactively. The switching element is activated merely via mechanical deformation, that is to say by connecting the plug to the socket, without relative positioning between individual parts of the detection unit being necessary.

According to one embodiment, the detection unit has an electrical circuit, wherein the switching element is configured so as to close the electrical circuit when activated. The switching element is in particular designed to connect two lines of the electrical circuit. If the plug is inserted completely into the socket, the switching element is activated and in this case connects the two lines of the electrical circuit. As a result of connecting the two lines, the electrical circuit is closed and is thus active. This is displayed by the detection unit as the correct positioning of the plug in the socket.

According to a further embodiment, the switching element is a crimping contact. This means that the switching element is mechanically crimped when the plug is inserted into the socket, as a result of which a contact in the circuit is closed.

According to a further embodiment, the switching element is designed to remove a separator between the two lines. By way of example, a fluid may prevent the two lines from being connected, and the switching element serves to force the fluid away and thus to electrically connect the two lines.

According to a further embodiment, the circuit may be an RFID transponder. The RFID transponder may in particular be designed to transmit a signal to a reader via an antenna in the electrically closed state, that is to say when the plug is correctly positioned in the socket. The reader may then output a signal that a plug is positioned correctly in the socket.

By way of example, the switching element may close a contact between a microchip of the RFID transponder and an antenna. As soon as the antenna is connected to the microchip, a signal may be emitted by the antenna.

If an RFID transponder is used, this furthermore has the advantage that further information may be output by the transponder to a reader in addition to a signal that indicates the correct positioning of the plug in the socket. This includes for example a serial number or the like of the plug or of the socket. The transponder could furthermore be assigned to an installer who is responsible for the respective plug connection by the installer providing the transponder with a signal following activation when the plug is connected to the socket. This signal may indicate the respective installer. The reader is then not only able to detect that the plug connection is correct, but it is additionally also possible to read who installed the plug connection.

According to a further embodiment, the circuit is designed as a (thin) film. This is particularly advantageous since, as a result of the small thickness, the circuit (or the detection unit with the circuit) is able to be attached to the plug or the socket without impairing the function thereof.

According to a further aspect, what is proposed is a plug for insertion into a socket of a plug and socket device as is described above.

According to a further aspect, what is proposed is a socket for receiving a plug of a plug and socket device as described above.

Further possible implementations of the invention also comprise combinations that are not explicitly mentioned of features or embodiments that are described above or below with respect to the exemplary embodiments. In this case, a person skilled in the art will also add individual aspects to the respective basic form of the invention as improvements or additions.

Further advantages and advantageous embodiments are indicated in the description, the drawings and the claims. In this case, the combinations of features indicated in the description and in the claims are in particular purely exemplary, meaning that the features may also be present on their own or else in combined form.

The invention is intended to be described in more detail below with reference to exemplary embodiments illustrated in the drawings. In this case, the exemplary embodiments and the combinations shown in the exemplary embodiments are purely exemplary and not intended to define the scope of protection of the invention. This is defined solely by the appended claims.

BRIEF DESCRIPTION OF THE DRAWINGS

Identical or functionally identical elements are identified below using the same reference signs.

DETAILED DESCRIPTION OF THE DRAWINGS

Figure 1:
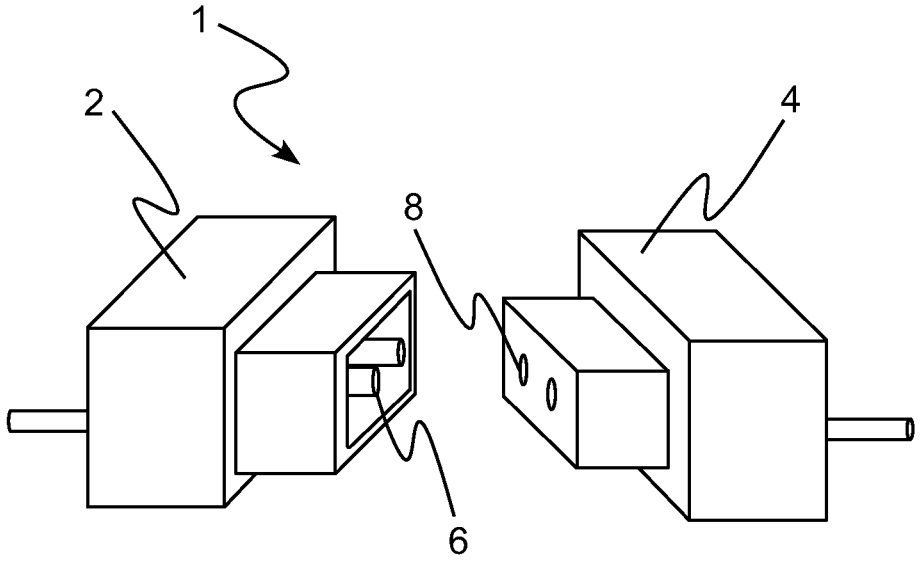
FIG. 1 is a schematic view of a plug and socket device.

FIG. 1 shows a plug and socket device 1 having a plug 2 and a socket 4. The plug 2 has for example contacts 6 that are able to be inserted into the socket 4 into corresponding receptacles 8. If the contacts 6 are connected to the receptacles 8, current flows via the plug connection. If however such a plug connection 1 is not joined together until the components abut, although there is electrical contact between the contacts 6 and the receptacles 8, the tightness of the connection and also resistance to vibrations may decrease over time. This may lead to the plug connection completely detaching.

Figure 2:
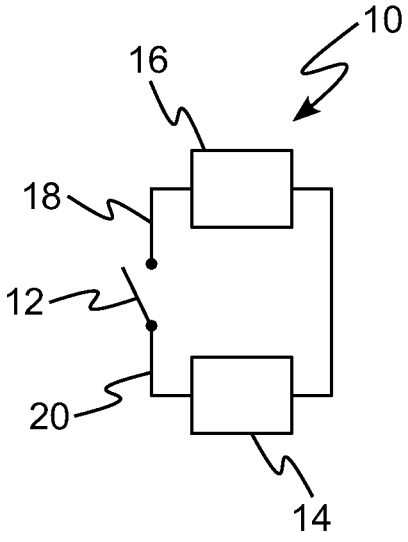
FIGS. 2 and 3 are schematic view of a detection unit of the plug and socket device of FIG. 1.
Figure 3:
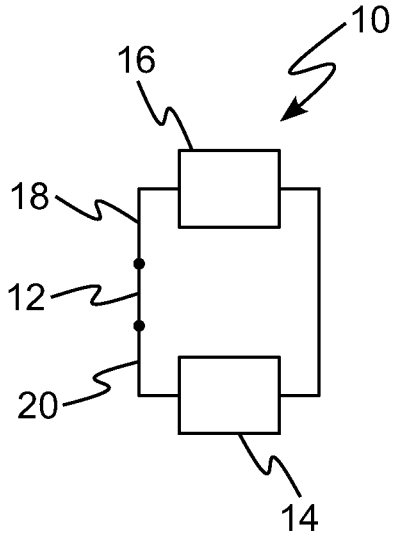

In order to detect whether the plug 2 is positioned correctly, that is to say until it abuts, in the socket 4, a detection unit 10 is therefore used in the plug and socket device 1 proposed here, as is described in more detail in FIGS. 2 and 3.

The detection unit 10 may be provided either on the plug 2 or on the socket 4. The detection unit 10 has a switching element 12 that is activated, that is to say closed, when the plug 2 is positioned correctly in the socket 4.

The switching element 12 is first of all open, as is illustrated in FIG. 2. If the plug 2 is inserted into the socket 4, the switching element 12 is mechanically activated, that is to say closed, as is illustrated in FIG. 3. This may be brought about for example through crimped contact, that is to say through mechanical pressure that acts on the switching element 12 as a result of the plug connection between the plug 2 and the socket 4.

If the switching element 12 is activated, a circuit of the detection unit 10, which is formed in the case shown here by a microchip 14 and an antenna 16, is thereby closed. In this case the switching element 12 connects line 18 and line 20 of the circuit. By closing the circuit, the antenna 16 may be supplied with current, and is then able to emit a signal to a reader (not shown). Transmitting the signal may indicate correct positioning of the plug 2 in the socket 4, since the antenna 16 is not supplied with current when the plug 2 is not correctly positioned in the socket 4, and is therefore not able to transmit a signal.

The antenna 16 may additionally transmit further information via the plug connection. This includes for example an identification number of the plug 2 and/or of the socket 4.

By virtue of the proposed plug and socket device, it is easily possible to detect whether a plug is positioned correctly in a socket. Since a detection unit used for this purpose is attached only to the plug or only to the socket, it is not necessary to exactly position the detection unit on both elements.

REFERENCE SIGNS

1 plug and socket device
2 plug
4 socket
6 contacts
8 receptacles
10 detection unit
12 switching element
14 microchip
16 antenna

What is claimed is:

1. A plug and socket device, comprising:

a socket;

a plug that is insertable into the socket, wherein the plug or the socket has a detection unit that is designed to detect correct positioning of the plug in the socket, the detection unit comprises a switching element that is designed to be mechanically activated in an event of correct positioning, the detection unit further comprises an electrical circuit, the switching element is a crimping contact, the switching element is configured so as to close the electrical circuit when activated, the switching element is configured to be closed by mechanical pressure which acts on the switching element as a result of a plug connection between the plug and the socket, and the detection unit is configured to detect whether the plug is inserted completely into the socket.

2. The plug and socket device according to claim 1, wherein the switching element is designed to connect two lines of the electrical circuit.

3. The plug and socket device according to claim 1, wherein the circuit is designed as a film.

4. The plug for insertion into the socket in the plug and socket device according to claim 1.

5. The socket for receiving the plug in the plug and socket device according to claim 1.

6. The plug and socket device according to claim 1, wherein the electrical circuit is an RFID transponder.

7. The plug and socket device according to claim 6, wherein the RFID transponder has an antenna, and the switching element is designed to supply the antenna with power in an activated state.

8. The plug and socket device according to claim 7, wherein the RFID transponder is designed to transmit a signal to a reader via the antenna in an electrically closed state.

9. The plug and socket device according to claim 8, wherein the signal contains information about a positioning of the plug in the socket and/or further information about the plug and/or the socket.

* * * * *